US005114211A

United States Patent [19]

Desanta

[11] Patent Number: 5,114,211

[45] Date of Patent: May 19, 1992

[54] CHAIR, IN PARTICULAR AN OFFICE CHAIR

[76] Inventor: Simon Desanta, Hollen, Im Loheden, D-4830 Gütersloh 12, Fed. Rep. of Germany

[21] Appl. No.: 581,730

[22] Filed: Sep. 12, 1990

[30] Foreign Application Priority Data

Sep. 12, 1989 [DE] Fed. Rep. of Germany ..... 3930361

[51] Int. Cl.[5] ..... A47C 3/00

[52] U.S. Cl. ..... 297/301; 297/304

[58] Field of Search ..... 297/300, 301, 302, 304

[56] References Cited

U.S. PATENT DOCUMENTS

| | | | |
|---|---|---|---|
| 594,679 | 11/1897 | Davis | 297/304 |
| 3,339,973 | 9/1967 | Doerner | 297/300 |
| 3,601,444 | 8/1971 | Doerner | 297/300 X |
| 4,707,028 | 11/1987 | Gamberini | 297/300 |
| 4,776,633 | 10/1988 | Knoblock et al. | 297/301 X |

*Primary Examiner*—Kenneth J. Dorner
*Assistant Examiner*—J. Bonifanti
*Attorney, Agent, or Firm*—Pollock, Vande Sande & Priddy

[57] ABSTRACT

A chair, in particular an office chair, has a vertical column (12) rising from a pedestal (10). From the top end of the column a bracket (16) projects forwards. A seat (20) is connected to the bracket and is supported in the rear region by a generally U-shaped led spring (24) fastened to the column (12). The seat (20) is fixedly connected approximately in the region of its front third to a support plate (18) attached to the bracket, and in the region of its rear third fixedly to a rigid bearing plate (22). On its underside, the bearing plate (22) has sleeves for receiving, in a displaceable manner, two open ends (38, 40) of the leg spring (24). The seat (20) is designed so as to be able to move at least in the region of its middle third.

8 Claims, 4 Drawing Sheets

CHAIR, IN PARTICULAR AN OFFICE CHAIR

FIELD OF THE INVENTION

The present invention relates to a chair, in particular an office chair, having a vertical column rising from a pedestal, a bracket projecting forwards from the top end of the column, a seat connected to the bracket and supported in the rear region by a leg spring fastened to the column, and a back rest supported in a spring-mounted manner by the leg spring.

BACKGROUND OF THE INVENTION

Chairs of this type are known in various embodiments. Thus, German Offenlegungsschrift 3,741,472 illustrates and describes a chair in which the seat is mounted pivotably at the front end of the bracket and the back rest is attached to the top end of the column so as to be able to pivot via a bow-shaped piece. A leg spring is fastened to the bracket and supports the rear region of the seat, and the back rest, in a spring-mounted manner. Another solution of the type mentioned, but in which an entirely different concept was adopted, is illustrated in European Patent 105,955. According to this patent, the seat is divided transversely into a front and rear seat part. The front seat part is fastened rigidly to the bracket while the rear seat part is supported via a leg spring fastened to the bracket and to the top end of the column. The back rest is fastened to the rear seat part and to the column via connecting rods and transition pieces.

Although, in general aspects of functionality and ergonomics are of primary importance in chair structures of the present type, there is also a considerable need for sturdy and simple solutions which can be produced at relatively low cost. From this point of view, the chair disclosed in European Patent 105,955 appears to be less favorable as it has a large number of shafts, joints, springs and other moving structural parts, which can result in high manufacturing and assembly cost and, as parts subject to wear, form a fundamental source of disturbance.

SUMMARY OF THE INVENTION

The invention has the object of providing a chair of the generic type which not only meets the requirements of functionality and ergonomics but makes do with few moving parts and may be manufactured at low cost.

This object is achieved according to the invention for a chair of the above type by the seat being fixedly connected approximately in the region of its front third to a rigid support plate attached to the bracket, by the seat being fixedly connected approximately in the region of its rear third to a rigid bearing plate which carries on its underside sleeves for receiving, in a displaceable and lockable manner, two open ends of the largely U-shaped leg spring, and by the seat being designed so as to be elastically movable at least in the region of its middle third.

Since the seat can move elastically in the middle region the chair can entirely dispense with the joints which are usually provided for the spring-mounted pivoting movement of the seat and the back rest. The rigid and large-area connection of the front and rear end region of the seat to the bracket and to the rear bearing plate permit a stable solution. Both the seat and the back rest are held spring-mounted by just one relatively simple leg spring. The leg spring has an additional function, as it may be locked on the underside of the rear bearing plate and in this way makes it possible to immobilize the spring mechanism. With the exception of the corresponding locking mechanism, no moving parts whatsoever are required.

Two sleeves spaced apart from one another are respectively located on each side of the bearing plate. As the rear bearing plate and hence the rear part of the seat are supported by the two backwardly projecting ends of the leg spring, the seat could have a tendency to sink to one side in the rear region in case of a laterally asymmetric load. However, this is prevented as a result of the torsional strength of the bearing plate, in conjunction with the spaced sleeves located on each side and receiving the ends of the spring.

In the event of the spring-assisted movement of the seat, not only are the rear ends of the leg spring displaced in the sleeves, but the angle between the ends of the leg spring and the seat simultaneously changes. This change in angle can be readily compensated for by the elasticity of the seat and the leg spring. The sleeves may optionally surround freely pivotable bearing bushes.

The back rest is preferably fastened to the rear bearing plate via a suitable transition piece, which can, in its turn, exert a spring action.

The largely U-shaped leg spring is supported adjustably in its apex region on the underside of the front bracket. The pre-tension is altered by adjusting the distance from the underside of the bracket.

The legs, extending from the front apex region of the leg spring preferably pass around journals projecting laterally from the top end of the column and continue from the top side of the journals to the sleeves.

BRIEF DESCRIPTION OF THE DRAWINGS

Preferred exemplary embodiments of the invention will now be described in more detail with reference to the attached drawings, in which.

DESCRIPTION OF PREFERRED EMBODIMENT

Figure 1:
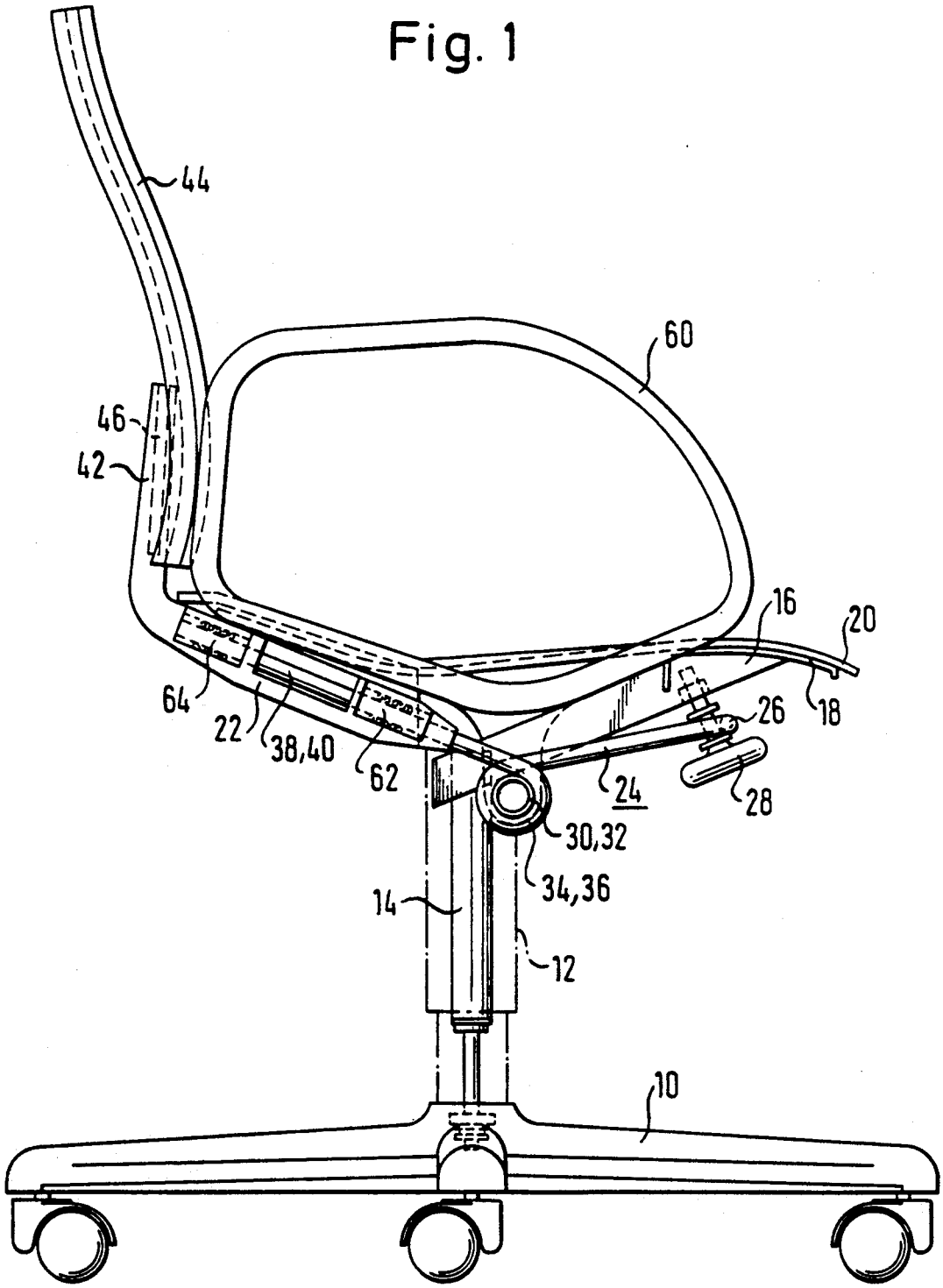
FIG. 1 is a side elevation view of a chair.
Figure 2:
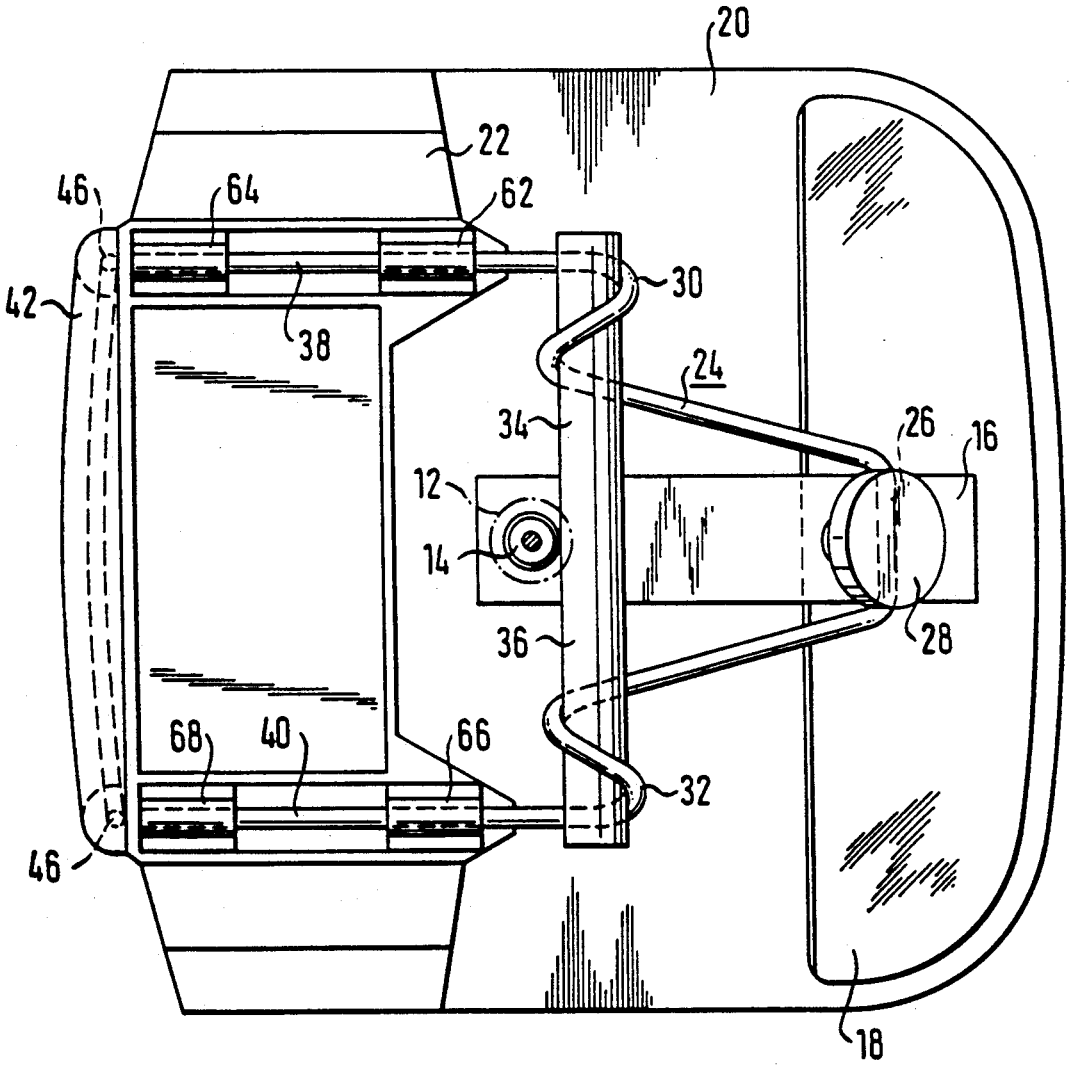
FIG. 2 is a bottom view plan.
Figure 3:
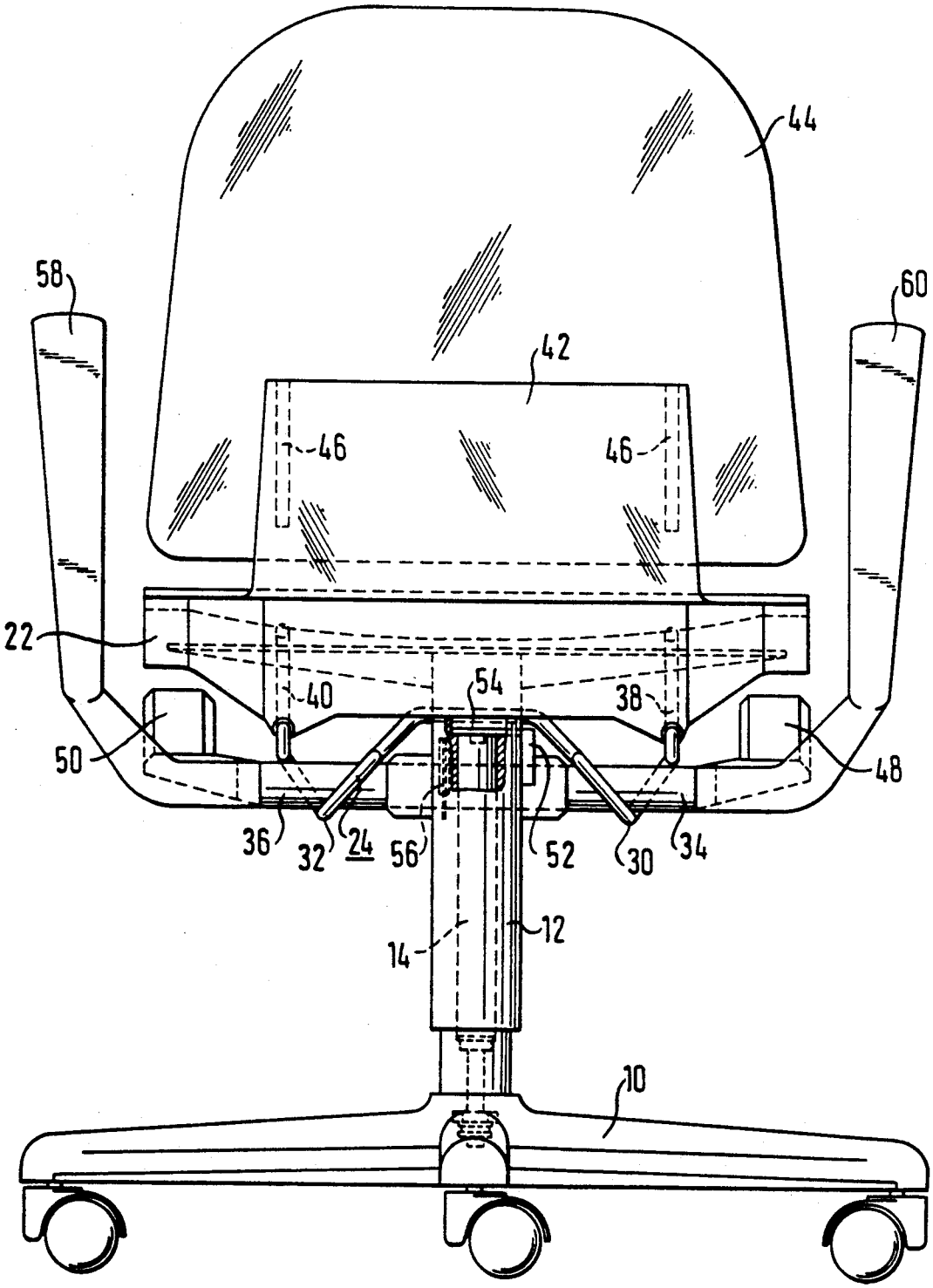
FIG. 3 is a rear elevation view.

A chair according to the invention and according to FIGS. 1 to 3 has a wheeled pedestal 10 from which a vertical height-adjustable column 12 rises which contains a pneumatic spring 14. A bracket 16 projects forwardly at an angle, relative to the seat direction, from the top end of the column 12. An essentially horizontal rigid support plate 18 extending transverse to the seat direction is fastened to the front end of the bracket 16 (FIGS. 1 and 2).

The front region of approximately one third or alternatively one quarter of a seat 20, which is made of relatively thin, flexible material, in particular of plastic, is fastened to the support plate 18. The seat 20 may carry upholstery (not shown).

A bearing plate 22 extending transversely to the seat and being, like the front support plate, essentially rigid, is fastened to the underside of the seat 20 in the rear end region of approximately one third of the seat. The bearing plate can be a plastic plate provided with stiffening profiles, as will be explained more fully hereinbelow.

A largely U-shaped leg spring 24, the exact form of which will be described in more detail later, has a forwardly located apex region 26 supported via an adjusting screw 28 on the underside of the front bracket 16. The two legs of the leg spring 24 extend obliquely downwards and in each case terminate in a coil 30, 32 about journals 34, 36 which project on both sides from the top end of the column 12. In the example shown, the journals 34, 36 are constituted by a continuous tubular section located forwardly of the top end of the column. The rear ends 38, 40, of the leg spring 24 extend from the top side of the journals 34, 36 to the underside of the bearing plate 22. The ends 38, 40 are guided on the underside of the bearing plate in a longitudinally displaceable and lockable manner, as will be explained later with reference to FIG. 4. In this way, the rear end region of the seat 20 is supported via the bearing plate 22 on the ends 38, 40 of the leg spring with a corresponding spring action.

The rear bearing plate 22 is bent back upwards at an obtuse angle at its rear end and there forms a support surface 42 to which a back rest 44 can be fastened in an appropriate manner. The connection between the support surface 42 and the back rest 44 may be elastic in design and comprise, for example, a further leg spring 46 which is integrated into the back rest 44 and whose ends are pushed into corresponding receptacles in the support surface 42.

The horizontal tubular section which forms the two journals 34, 36 on the front side of the column 12 can simultaneously serve at both ends to receive adjusting levers 48, 50 for the height-adjustment and locking of the seat, respectively. The adjusting lever 48 has a shaft (not shown) located inside the journal 34 formed as a tube and at the end of which a pressing element 52 is arranged which acts upon a release pin 54 at the top end of the pneumatic spring 14. The other adjusting lever 50 likewise has a shaft which actuates a Bowden cable 56 which will be referred to later in further detail. Arm rests 58, 60 are furthermore attached, according to FIGS. 1 and 3, to the journals 34, 36.

The form of the bearing plate 22 and its interaction with the rear ends 38, 40 of the leg spring will be explained in more detail later with reference to FIG. 4.

Figure 4:
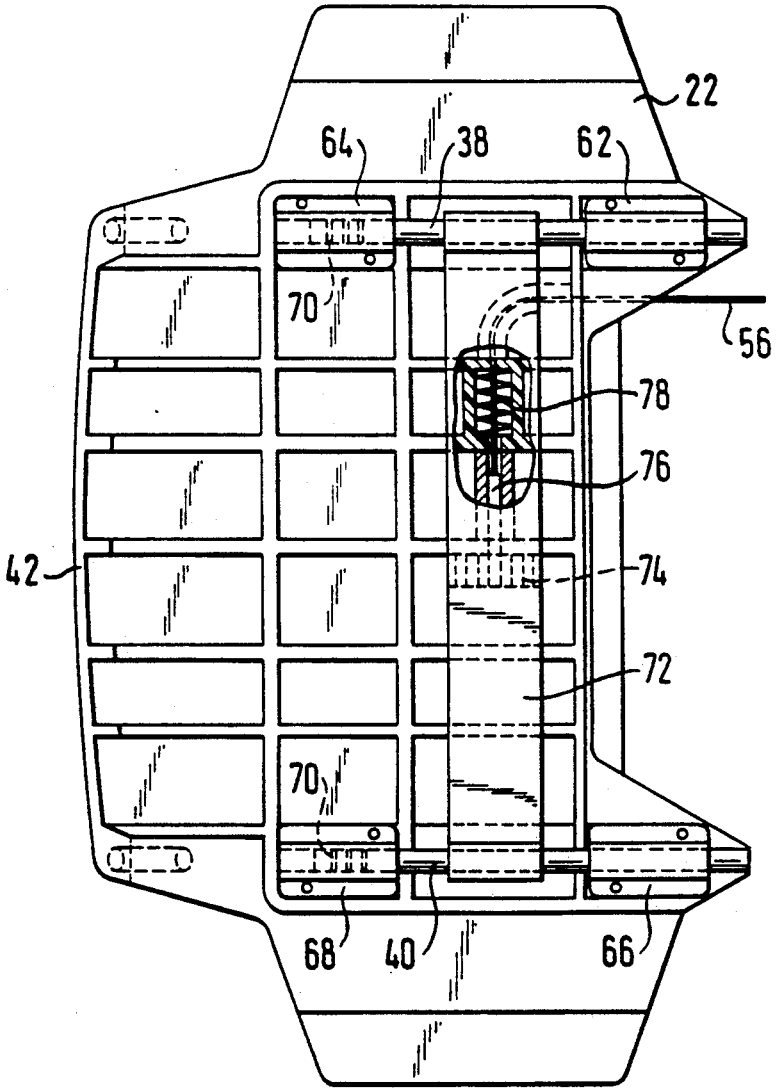
FIG. 4 is a bottom plan view of the rear bearing.

The bearing plate 22 has on the underside a rib structure, shown in FIG. 4, in order to stiffen it. The two ends 38, 40 of the leg spring 24 are guided in a longitudinally displaceable manner in two sleeves 62, 64 and 66, 68, respectively, spaced apart axially. To enable the ends 38, 40 of the spring to be displaced smoothly in the sleeves 62, 64, 66, 68, needle bearings 70 are located in the sleeves above and below the ends of the spring, i.e., in the main directions of stress.

When the rear region of the seat is stressed on one side, excessive yielding of just one end 38, 40 of the leg spring is prevented by the fact that both the front support plate and the rear bearing plate 22 extend essentially over the entire width of the seat 20 and are fixedly connected to it. Lateral sinking of the bearing plate 22 is ruled out by its torsional strength in conjunction with the four-point bearing of the ends of the spring in the four spaced apart sleeves 62, 64, 66, 68.

Instead of the needle bearings, it is also possible to use a bearing which consists of a cylindrical tube, a cylindrical plastic bearing cage and an annular ball-bearing receptacle arranged at the end of the latter. Cylindrical guides of this type are used, for example, for machine tools.

The two ends 38, 40 of the spring are fixedly connected between the sleeves 62, 64, 66, 68 by a crosspiece 72 running transverse to the bearing plate 22. A plurality of locking teeth 74 into which a bar 76 can engage are situated on the crosspiece 72. The bar 76 is pre-tensioned into the locking position by a spring 78. The Bowden cable 56, already mentioned, is guided to the underside of the bearing plate 22 and connected to the bar 76 such that the locking can be released by actuating the adjusting lever 50 (FIG. 3). Instead of the locking mechanism described, it is possible to use a locking mechanism of a different type, for example a pneumatic spring which can be locked in an infinitely adjustable manner.

The rear support surface 42 which serves to receive the back rest can be seen in FIG. 4.

I claim:

1. A chair comprising (a) a vertical column (12) rising from a pedestal (10);

(b) a bracket (16) projecting forwardly from a top end of said column;

(c) a seat (20) connected to said bracket and supported in a rear region of said seat by a leg spring (24) having a generally U-shaped portion and two open ends (38, 40); and (d) a back rest (44) supported in a spring-mounted manner by said leg spring, wherein said seat (20) is fixedly connected approximately in the region of its front third to a support plate (18) attached to said bracket (16), and said seat is fixedly connected approximately in a region of its rear third to a rigid bearing plate (22) which carries sleeves (62, 64, 66, 68) on an underside of said bearing plate, and in spaced relation to one another on opposite lateral sides of said bearing plate, for receiving, in a displaceable and lockable manner, said two open ends (38, 40) of said leg spring (24), and the seat (20) is designed so as to be able to move at least in the region of its middle third.

2. Chair according to claim 1, wherein the back rest (44) is fastened to the bearing plate (22).

3. Chair according to claim 1, wherein an apex region (26) of said leg spring (24) is adjustably supported on an underside of said bracket (16).

4. Chair according to claim 3, wherein said leg spring comprises legs extending from said apex region (26) of said leg spring, then passing around journals (34, 36) projecting laterally from a top end of said vertical column (12) and extending from a top side of said journals to said sleeves (62, 64, 66, 68).

5. Chair according to any one of claims 1, 2 or 4, comprising needle bearings (70) in said sleeves (62, 64, 66, 68) for smooth guidance of said ends (38, 40) of said spring.

6. Chair according to any one of claims 1, 2 or 4, wherein said ends (38, 40) of said leg spring are fixedly connected beneath said bearing plate (22) by a crosspiece (72) extending transversely over said bearing plate, and wherein said crosspiece is locked by a locking mechanism (74, 76) in a plurality of positions of said ends (38, 40) of said spring relative to said sleeves.

7. Chair according to claim 6, wherein said locking mechanism comprises a Bowden cable (56, 76, 78).

8. Chair according to any one of claims 1, 2 or 4, wherein said locking mechanism comprises a pneumatic pressure spring adapted to be locked in a plurality of positions.

* * * * *